United States Patent [19]

Mazzorana

[11] 4,184,378

[45] Jan. 22, 1980

[54] STARTER MOTOR FOR AN INTERNAL COMBUSTION ENGINE

[75] Inventor: Alfred B. Mazzorana, Venissieux, France

[73] Assignee: Societe de Paris et du Rhone, Lyon, France

[21] Appl. No.: 934,038

[22] Filed: Aug. 16, 1978

[30] Foreign Application Priority Data

Aug. 30, 1977 [FR] France ..... 77 26787

[51] Int. Cl.[2] ..... F02N 11/02

[52] U.S. Cl. ..... 74/7 A

[58] Field of Search ..... 74/7 A, 7 R, 6

[56] References Cited

U.S. PATENT DOCUMENTS 3,955,427 5/1976 Squires ..... 74/7 A.

FOREIGN PATENT DOCUMENTS 2439981 3/1976 Fed. Rep. of Germany ..... 74/7 A 2727888 12/1977 Fed. Rep. of Germany ..... 74/7 A

*Primary Examiner*—Wayne L. Shedd

*Attorney, Agent, or Firm*—Browdy and Neimark

[57] ABSTRACT

A starter motor assembly for an internal combustion engine wherein a yoke is connected between an electro-magnetic switch and a pinion engaging device connected by a helical drive with an armature shaft. At the point of energization of the electro-magnetic switch the yoke causes the pinion to advance into a position to engage an engine drive gear. In the rest position of the starter motor the yoke is resiliently retained between the device and a cap which is itself retained over the end of a case secured against axial movement to the armature shaft. A pinion return spring engages between a stop on the device and the cap.

5 Claims, 2 Drawing Figures

STARTER MOTOR FOR AN INTERNAL COMBUSTION ENGINE

DESCRIPTION

Figure 1:
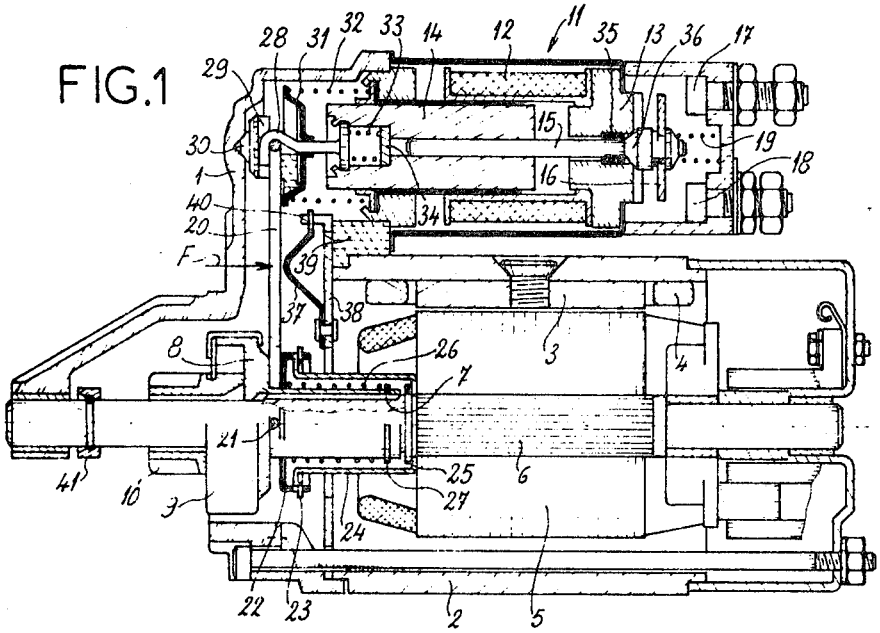

The present invention relates to a starter motor assembly for an internal combustion engine, and comprising a double-wound electro-magnetic switch having a moving contact coupled to a yoke joined to a drive device for moving a pinion axially for driving engagement with a drive gear of the engine, internal helical grooves being provided on the drive device which co-operate with helical grooves formed on the armature shaft of the electric motor comprised in the assembly.

The value of this device with helical grooves will be recalled below, in connection with the phenomenon of "tooth conflict", that is to say with the fact that the teeth on the pinion, which is joined to the drive device by means of a starter gear, may not be in a suitable position, relative to the teeth on the drive ring gear of the engine, to engage with the latter when the starter motor is energised. In order to resolve this difficulty, the moving core of the switch is allowed to move until it comes to rest against the fixed core, whilst compressing a so-called "tooth conflict" or "safety" spring which stores energy and, by subsequently being released, enables the teeth on the pinion to penetrate between those on the ring gear as soon as this becomes possible. This "tooth conflict" spring is usually placed on the drive device of the pinion; previously, it has also been placed in the region of the switch, and more particularly in the moving core, as described, for example, in the Specification of French Pat. No. 1,570,596 of March 25th 1968, in which a rod connecting the yoke to the moving contact is mounted so as to slide in the said moving contact, with the interposition of a spring which acts as a "tooth conflict" spring. With the provision of helical grooves, a very slight penetration of the teeth on the pinion between those on the ring gear is sufficient because, under the action of the resisting torque of the internal combustion engine and of the helical grooves, the pinion will move forward by itself without rotation, in an axial direction, so as to engage completely with the ring gear until it is brought to rest, in the axial direction, by means of a stop with which the armature shaft is provided. From this moment, and only from this moment, the starter motor is capable of transmitting a torque and a rotational drive to the drive ring gear of the engine. The helical grooves therefore make it possible to save energy and it can be noted that, as soon as the starter motor rotates, the initial force, which served to compress the "tooth conflict" spring, is no longer required by the electro-magnetic switch. For this reason, as soon as the main contact, which feeds the inductor for setting the armature in rotation, is closed, the so-called "pull-in" winding of the switch, which causes the strongest attraction of the moving core, is cut off, and the electric current is only maintained to the so-called "holding" winding which consumes 5 to 6 times less electrical energy and will be adequate throughout the entire period of starting, by virtue of the action of the helical grooves which has already been explained. As soon as the first drive takes place from the engine, the increase in the rotational speed causes the pinion to return to its rest position, by means of the conjugate action of the helical grooves and the inertias.

During the forward movement of the pinion, which is "swallowed" by the ring gear without rotating, although the armature shaft is already rotating, the yoke must also move forwards if it is positively joined to the drive device of the pinion. This movement is not very compatible with the usual method of construction, in which the yoke consists of a rigid lever articulated at an intermediate point about a fixed axis. In order to overcome this defect, the production of a flexible yoke, which is capable of absorbing the movement of the pinion by means of elastic deformation, has already been envisaged, but, in this case, the yoke must be much more rigid in the direction which corresponds to the initial positive forward drive of the pinion, and this gives rise to production difficulties. Of course, the difficulty can also be avoided by providing the moving contact of the switch with a stroke which is such that the movement of the yoke corresponds exactly to the stroke of the pinion; however, this leads to a very large stroke of the moving contact, which must moreover be perfectly adjusted to suit that of the pinion, and leads to poor utilisation of the helical grooves, since the value of the latter is in fact to exert an attraction on the pinion after it has only been pushed by the yoke over a length which is just sufficient to obtain an initial engagement with the ring gear.

In order to overcome all these disadvantages, the production of a starter motor of the type defined in the introduction has already been envisaged in French Pat. No. 1,199,879; in this starter motor, the yoke is unilaterally joined to the pinion in the direction of the thrust of the pinion towards the ring gear, the said drive device being subjected to the direct action of an independent return spring. The unilateral connection between the yoke and the drive device of the pinion, in the direction of the thrust towards the ring gear, makes it possible to omit the contact between the yoke and the drive device, provided the natural stroke of the pinion is greater than that of the yoke. On the other hand, this unilateral connection does not enable the yoke to bring the pinion back to its rest position and the pinion return spring is therefore necessary. In theory, this solution has the following advantages:

The fact that the yoke is unilaterally supported on the drive device makes it possible to have, near the switch, a total cut-off stroke which is independent of a position-setting of the pinion, and this setting, which has become unnecessary, is omitted without it being necessary to design an exceptionally precise construction.

The fitting of a direct-action pinion return spring permits extreme simplification of the connection between the yoke and the drive device of the pinion, and the friction components in particular, (shoes, pins and the like), which are usually fitted, are therefore omitted.

The fact that the pinion can move under the action of the helical grooves, independently of the limiting position of the yoke, can be put to advantage in order to shorten the stroke of the switch to the minimum value which is sufficient slightly to engage the teeth on the pinion with the teeth on the ring gear, which leads to better utilisation of the portative forces in the electromagnetic switch and to a saving in the energy required to obtain the complete engagement of the teeth on the pinion with the teeth on the ring gear.

However, the only method described in the above-mentioned French Pat. No. 1,199,879, for putting this solution into practice, possesses serious disadvantages relating to the fitting of the return spring. Since this spring is placed on the side of the drive device which is opposite the armature, between the drive device and the ring gear, the "nose" of the starter motor must have large dimensions in order to house the said spring. One of the ends of the return spring rests on a piece which is joined to the "nose" of the starter motor and is therefore fixed, and the other end rests on a piece which is joined to the drive device and is consequently caused to rotate at a high speed. It is easy to understand that an assembly of this kind gives rise to frictional forces which cause wear.

According to the present invention there is provided a starter motor assembly for an internal combustion engine provided with a drive gear, the starter motor assembly comprising a pinion axially movable for engagement with the drive gear, an electric motor comprising an armature mounted on an armature shaft, a drive device carried by the armature shaft for axial movement thereon to move the pinion axially, a helical groove connection between the armature shaft and the drive device whereby upon rotation of the armature relative to the drive device the drive device will move axially of the armature shaft, a return spring urging the pinion and drive device in a direction axially to retract the pinion from the drive gear, an electro-magnetic switch having a moving contact and which when in a contact closed condition provides for the supply of electric current to the electric motor to cause rotation of the armature thereof, a yoke connected between the moving contact and the drive device to urge the drive device in a direction to engage the pinion with the drive gear responsive to movement of the moving contact in a contact closing direction, a case surrounding a helically grooved tubular portion of the drive device and secured at one end against axial movement relative to the armature shaft, a stop on the said tubular portion of the drive device, and a cap retained over the other end of the case, the return spring bearing at opposite ends against the cap and the stop and the yoke being resiliently charged between the cap and the drive device when the pinion is in a rest position retracted from the drive gear.

In this assembly, the return spring is housed between the drive device and the armature, partly under the armature coil, which makes it possible to have a much shorter "nose" on the starter motor assembly and even to shorten the whole starter motor assembly. Moreover, the surfaces which support the return spring at its two ends do not move relative to one another during rotation and any friction, which causes wear, is avoided. Furthermore, the resilient clamping of the end of the yoke, which is achieved by means of this assembly, provides an anti-vibration function.

Preferably the assembly includes an electric starter motor which includes an elastic retaining ring retaining said other end of the case and provided with a pair of lugs, the said cap comprising a skirt provided with two diametrically opposite apertures in which are engaged said lugs. Preferably also the armature is comprised by a bundle of laminations mounted on the armature shaft and wherein the assembly comprises a retaining ring carried by the armature shaft, said one end of the case being axially fixed between the retaining ring and the bundle of laminations.

Conveniently the yoke may have a pair of prongs which possess, at their ends, bent parts which turn towards one another and are engaged between a body portion of the drive device and the said cap.

Figure 2:
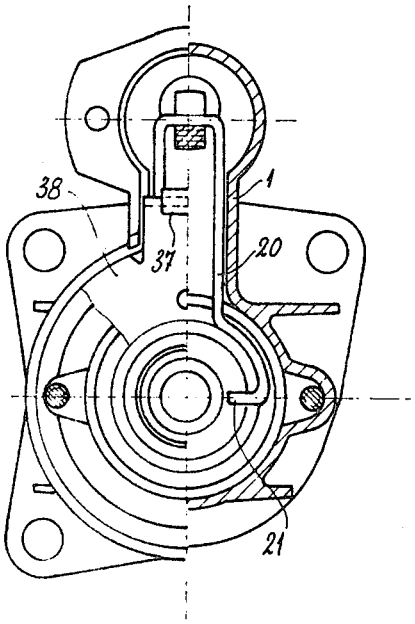

The invention will be understood more clearly with the aid of the following description, in which reference is made to the attached simplified drawings which show, by way of a non-limiting Example, an embodiment of this starter motor for an internal combustion engine. In the drawings:

FIG. 1 is a view, in longitudinal cross-section, of a starter motor according to the invention; and FIG. 2 is an end view, partly in cross-section, of the motor of FIG. 1.

FIG. 1 shows the conventional main components of a starter motor, namely a housing 1 into which is inserted a casing 2 supporting poles 3 of a stator or inductor, which are surrounded by exciter windings 4, and a rotor or armature 5 which is carried for rotation with a shaft 6. This shaft 6 is provided with helical grooves 7 which co-operate with complementary internal helical grooves formed on a drive device 8, which is connected via a starter drive 9 to a pinion 10, which can engage with a toothed ring gear which is not shown. The inductor supply is controlled by means of an electro-magnetic switch 11 fixed to the housing 1, which comprises, in a known manner, fixed pull-in and holding windings 12, a fixed core 13 and a moving contact arrangement. The moving contact arrangement comprises a moving core 14, a rod 15 which passes through both the fixed core 13 and the moving core 14 through which it can slide, and a moving contact 16 which is carried by the rod 15 and makes it possible to establish an electrical current between two fixed contacts 17 and 18, the inductor of the starter motor being supplied via these contacts. The contact-bearing rod 15 is normally kept in the open-contact position by means of a spring 19. Furthermore, the switch 11 ensures the axial movement of the drive device 8 of the pinion by means of a gearing lever or yoke 20, which is connected at opposite ends, to the moving contact of the switch and to the drive device 8 of the pinion and which is supported at an intermediate point for pivotal movement.

As illustrated, the above-mentioned yoke 20 does not consist of a lever mounted so as to pivot about a fixed axis, but consists of a simple member which comprises two prongs and can be seen from the front in FIG. 2. Near the drive device 8, the ends 21 of the two prongs of the yoke 20 are bent so as to turn towards one another and, in the rest position, they are elastically squeezed between the body of the drive device 8 and a stamped cap 22. This cap possesses a cylindrical skirt provided with two diametrically opposite apertures in which are engaged lugs formed on an elastic retaining ring 23. The retaining ring 23 retains an out-turned flange at one end of a case 24 which surrounds the helically grooved parts of the shaft 6 and of the drive device 8 and which is co-axial with the shaft and the drive device. The other end of the case 24 is axially retained between the bundle of laminations of the rotor 5 and a retaining ring 25 carried by the shaft 6. A helical pinion return spring 26 is mounted around the grooved tubular part of the drive device 8 under the case 24. This return spring is compressed and bears at opposite ends against the cap 22 and against another locking ring 27 mounted on the tubular part of the drive device. FIG. 1 shows all these components at rest, in which position they act as an anti-vibration device.

Near the switch 11, the yoke 20 is coupled to a hook 28, the base of which is secured by crimping to the moving core 14, and a coupling piece 29, which is equipped with a pointed extension 30 is additionally provided on the hook 28. A cap 31 is mounted around and secured to the rod of the hook 28 and serves as a stop for a helical return spring 32 of the moving core 14. In the rest position, this return spring 32 holds the pointed extension 30 of the coupling piece 29 in a complementary conical bearing formed on the housing 1.

The moving core 14 possesses, at the end opposite the moving contact 16, a recess which is closed by the base of the coupling hook 28 and in which is housed a spring 33 which bears at opposite ends against the above-mentioned base and against an elastic stop 34 which, at rest, is held by the spring 33 against the bottom of the recess in question.

The elastic stop 34 co-operates with the end of the contact-bearing rod 15, which rod is mounted so as to slide inside a bore in the moving core 14 which opens out at the bottom of the above-mentioned recess, when the moving core 14 is attracted towards the fixed core 13, in order to keep the moving cntact 16 pressed against the fixed contacts 17 and 18. It should be noted that, in this case, the contact-bearing rod 15 is made of a non-magnetic material which is as light as possibleand that, when passing through the fixed core 13, it is guided in a plastics sleeve 35 which damps vibrations. This anti-vibration device is completed by a support with a conical bearing 36 on the contact bearing rod 15, which co-operates with a complementary conical flared part in the fixed core 13.

Finally, adjacent the intermediate part of the yoke 20, a device is provided which serves both as a fulcrum for this yoke and as a "tooth against tooth" spring. This device consists of a shaped leaf-spring 37 riveted on a plate 38 which is held stationary between the housing 1 and the casing 2 and which itself serves to retain a gasket 39. The plate 38 is extended, in the direction of the switch 11, by a lug which itself possesses a free end 40 which is bent over at right angles, there being provided in the bent over free end an aperture receiving an end tab of the spring 37. It can be seen that this device makes it possible to impart a pre-stress to the spring 37, so that it only begins to yield upon a given force F being exerted thereagainst.

It will be noted that, in the rest position, there is a running clearance between the yoke 20 and the spring 37, as shown in FIG. 1, so that the yoke is not supported at an intermediate point. It is thus possible to be certain that the contacts and supports are properly provided near the drive device 8 of the pinion and near the moving core 14.

The functioning of the starter motor is described below, with reference to FIG. 1.

In a first and simplest case, functioning is envisaged in which the "tooth against tooth" phenomenon does not occur. In a first stage, the ignition key of the vehicle equipped with the starter motor in question is switched on and this feeds the pull-in winding of the switch 11 and causes an initial movement of the moving core 14, which core travels through an idle stroke until the yoke 20, after having rotated slightly about fulcrum on the drive device 8 of the pinion, has taken up the running clearance which separates it from the spring 37. During this first stage, there is no axial movement of the pinion 10.

During a second stage, the yoke 20 rests on the spring 37, the resistance of which is chosen to be greater than the force required for the pinion 10 to penetrate into the ring gear. The moving core 14 continues its stroke in the direction of the fixed core 13, the yoke 20 pivots about its support zone on the spring 37, and the teeth on the pinion 10 engage with the teeth on the ring gear. Simultaneously, the moving core 14 pushes back the contact-bearing rod 15, the spring 33 for pressing the moving contact being chosen so as to offer a greater resistance than that of the release spring 19 in its most compressed position. Electrical contact is established to feed the inductor and cause the armature with its shaft 6 to rotate, the pull-in winding is cut off and only the holding winding is fed, the action of the helical grooves 7 being such that the switch 11 only needs to provide a small force. Finally the moving core 14 comes to rest against the fixed core 13 and, in this end-of-stroke position, the spring 33 is compressed so as to exert a pressure on the contact 16. Also at this moment, the yoke 20 arrives in a final position.

In a third stage, the pinion 10 continues to move forward axially up to its stop 41 formed by a ring carried by the shaft 6, solely under the action of the helical grooves, the yoke 20 remaining in its final position which was reached previously. The pinion return spring 26 is then compressed to the maximum extent between the cap 22 and the retaining ring 27.

Finally, in a fourth and last stage, the internal combustion engine, started up by the starter motor, has been set in motion and the ignition is "cut" so as to stop the feed to the windings 12 of the switch 11. The moving core 14 returns to its initial rest position, initially under the conjugate action of the release spring 19 and the return spring 32, and then under the action of the return spring 32 alone, the spring 33 for pressing the moving contact also coming into play, in an accessory capacity, in order to disengage the moving core, within the limit of its compression stroke. The inductor of the starter motor is no longer fed and the pinion 10 is returned to its rest position by the "screwing-up" effect due both to the action of the helical grooves and to the inertia of the armature, this effect being coupled with the force of the return spring 26.

In a second case, which is derived from the above case, functioning is envisaged in which the "tooth against tooth" phenomenon does in fact occur. In this case, the functioning differs from that described above only in the manner in which the teeth on the pinion 10 penetrate between those on the ring gear:

The first stage is strictly identical to the case described above.

During the second stage, the yoke 20 pivots, since it is resting on the spring 37, and the pinion 10 is pushed towards its stop 41 until its teeth encounter the teeth on the ring gear, on which the pinion is brought to rest.

In the following stage, with the switch continuing to pull the yoke 20, the spring 37 collapses under the action of a force greater than the value F and enables the moving core 14, which is pushing the rod 15, to bring the moving contact 16 against the fixed contacts 17 and 18. Simultaneously, and in a very short time which allows the inertias to come into play, the pinion 10 begins to rotate, the spring 37 expands and the teeth on the pinion 10 engage with the teeth on the ring gear. It should be noted here that a very slight initial penetration of the teeth is sufficient to allow the helical grooves to fulfil their function, which is moreover required in order to cut off the pull-in winding.

Thereafter, the procedure of the third stage of the case described above remains the same and the fourth stage obviously remains unchanged.

It can be seen that the functioning described above, which utilises to the maximum extent the axial drive effect of the helical grooves, makes it possible to standardise the stroke of the moving contact of the switches which, in this case, is not directly related to the distance between the pinion and the ring gear or therefore to the stroke of the pinion.

I claim:

1. A starter motor assembly for an internal combustion engine provided with a drive gear, the starter motor assembly comprising a pinion axially movable for engagement with the drive gear, an electric motor comprising an armature mounted on an armature shaft, a drive device carried by the armature shaft for axial movement thereon to move the pinion axially, a helical groove connection between the armature shaft and the drive device whereby upon rotation of the armature relative to the drive device the drive device will move axially of the armature shaft, a return spring urging the pinion and drive device in a direction axially to retract the pinion from the drive gear, an electro-magnetic switch having a moving contact and which when in a contact closed condition provides for the supply of electric current to the electric motor to cause rotation of the armature thereof, a yoke connected between the moving contact and the drive device to urge the drive device in a direction to engage the pinion with the drive gear responsive to movement of the moving contact in a contact closing direction, a case surrounding a helically grooved tubular portion of the drive device and secured at one end against axial movement relative to the armature shaft, a stop on the said tubular portion of the drive device, and a cap retained over the other end of the case, the return spring bearing at opposite ends against the cap and the stop and the yoke being resiliently charged between the cap and the drive device when the pinion is in a rest position retracted from the drive gear.

2. A starter motor assembly according to claim 1, which includes an elastic retaining ring retaining said other end of the case and provided with a pair of lugs, the said cap comprising a skirt provided with two diametrically opposite apertures in which are engaged said lugs.

3. A starter motor assembly according to claim 1, wherein the armature is comprised by a bundle of laminations mounted on the armature shaft and wherein the assembly comprises a retaining ring carried by the armature shaft, said one end of the case being axially fixed between the retaining ring and the bundle of laminations.

4. A starter motor assembly according to claims 1, 2 or 3, wherein the yoke has a pair of prongs which possess, at their ends, bent parts which turn towards one another and are engaged between a body portion of the drive device and the said cap.

5. A starter motor assembly constructed and arranged to operate substantially as herein described with reference to and as illustrated in the accompanying drawings.

* * * * *